US005803249A

United States Patent [19]

Harsanyi, Jr. et al.

[11] Patent Number: 5,803,249

[45] Date of Patent: Sep. 8, 1998

[54] MEDICAL CLEAN UP KIT

[76] Inventors: Steve Harsanyi, Jr., 13870 Laura Ratcliff Ct., Centreville, Va. 20120; Dace L. Edwards, 8993 McDowell Commons, Manassas, Va. 22110

[21] Appl. No.: 826,966

[22] Filed: Apr. 9, 1997

Related U.S. Application Data

[60] Provisional application No. 60/019,115, Jun. 3, 1996.

[51] Int. Cl.[6] ..... B65D 85/00

[52] U.S. Cl. ..... 206/233; 206/494; 206/812

[58] Field of Search ..... 206/223, 438, 206/233, 440, 494, 812, 823, 210; 220/4.21, 4.27

[56] References Cited

U.S. PATENT DOCUMENTS

| | | | |
|---|---|---|---|
| 2,826,338 | 3/1958 | Davis | 220/555 X |
| 4,004,687 | 1/1977 | Boone | 206/210 X |
| 4,139,114 | 2/1979 | Long et al. | 220/4.27 X |
| 4,524,871 | 6/1985 | Klinger . | |
| 4,578,119 | 3/1986 | Marcus et al. . | |
| 4,702,378 | 10/1987 | Finkel et al. . | |
| 4,790,436 | 12/1988 | Nakamura | 206/494 |
| 4,889,255 | 12/1989 | Schiemann | 220/555 X |
| 4,946,033 | 8/1990 | Conner . | |
| 5,007,531 | 4/1991 | Lighten | 206/823 X |
| 5,190,049 | 3/1993 | Briggs et al. . | |
| 5,261,531 | 11/1993 | Nieves . | |
| 5,439,104 | 8/1995 | Wolska-Klis . | |
| 5,490,608 | 2/1996 | Hawkins | 220/555 X |

FOREIGN PATENT DOCUMENTS

| | | |
|---|---|---|
| 899958 | 6/1962 | United Kingdom . |
| 2142895 | 1/1985 | United Kingdom . |

*Primary Examiner*—Jacob K. Ackun
*Attorney, Agent, or Firm*—Richard C. Littman

[57] ABSTRACT

A medical clean up kit made up of a container with multiple compartments for storing the clean up material. A first compartment dispensively houses a supply of moistened towelettes saturated with anti-pathogenic agents for destroying various viruses and bacteria. A second compartment dispensively houses a supply of dry towelettes. Various lids and closures are disclosed for sealing the compartments, and preventing the accidental spillage of anti-pathogenic agents which might precipitate from the moist towelettes.

6 Claims, 5 Drawing Sheets

MEDICAL CLEAN UP KIT

CROSS-REFERENCE TO RELATED APPLICATION

This application claims the benefit of U.S. Provisional Patent Application Ser. No. 60/019,115, filed Jun. 3, 1996.

BACKGROUND OF THE INVENTION

1. Field of the Invention

The present invention relates to medical cleaning kits. More specifically, the invention relates to a medical clean up kit used for cleaning and disinfecting after the spillage of blood and other bodily fluids, wherein two containers are provided for the dispensing of wet sterilizing towelettes and dry towelettes, respectively.

2. Description of Prior Art

The need for providing a safe and efficient means of cleaning and disposing spills of blood and other bodily fluids has long existed. The associated safety issues have been further magnified due to the number of viruses and bacteria which may be transmitted through the aforementioned bodily fluids. During emergency situations, it often becomes necessary to clean minor spillages of blood in the immediate area. Oftentimes, an orderly may not be available to immediately perform the task, thereby leaving spillage, which may be infectious, to unnecessary exposure. This is often the case in emergency rooms, operating rooms, and ambulances, where the nature of the emergency necessarily requires that the situation be brought under complete control and that personnel be evacuated before an orderly may be summoned to perform the cleaning task. Furthermore, there may be a time delay before the actual cleaning takes place and minor spills of contaminated material remain unnecessarily exposed where unknowing parties may accidentally make detrimental contact.

While there exist systems and apparatuses for cleaning such spillage, those devices are not sufficiently convenient that any personnel attending a medical procedure could immediately perform the clean up process. The materials and anti-pathogenic agents available are often scattered in the medical facility. Furthermore, most anti-pathogenic agents used for cleaning purposes are readily accessible only to an orderly. Finally, anti-pathogenic agents are not packaged in such a manner as to allow quick and easy access or convenient use. Despite the availability of portable kits for various types of personal use, currently no such kits exist for in situ cleaning of bodily spillage.

Accordingly, a system for cleaning blood and other bodily spillage which is readily accessible to all medical personnel, safe for use by all medical personnel, and conveniently packaged would be beneficial.

While the prior art discloses a variety of packaging, none are suited for use in a medical environment where spills of bodily fluids typically occur and require immediate cleanup. For example, U.S. Pat. No. 4,524,871 issued on Jun. 25, 1985 to Klinger discloses a receptacle for containing disposable cloths and a stick-like container in separate compartments. The stick-like container may be used to store items such as lipstick or liquid cleaner.

U.S. Pat. No. 4,578,119 issued on Mar. 25, 1986 to Marcus et al. discloses a method for clean up of blood spills which utilizes a solid, pulverulent composition suited for destroying pathogenic activity. The composition includes a chlorine source sufficient to provide an available chlorine level which is 5,000 to 65,000 ppm. When placed in contact with blood spills, the composition absorbs the liquid and yields hypochlorous acid.

U.S. Pat. No. 4,702,378 issued on Oct. 27, 1987 to Finkel et al. discloses a comprehensive kit for providing items useful to the hygienic care of infants. The kit includes wet and dry towels, baby powder, soap, and a fresh diaper. All of the items are contained in separate compartments of the kit.

U.S. Pat. No. 4,946,033 issued on Aug. 7, 1990 to Conner discloses a combination skin cleaner and towel for cleaning up grease or grime which is packaged in a dual pouch container. The first pouch contains a cleaning composition and the second pouch contains a towel for removing the cleaning composition from one's hands. The two compartments are separated by a seam.

U.S. Pat. No. 5,190,049 issued on Mar. 2, 1993 to Briggs et al. discloses a kit for obtaining and submitting samples of blood for testing. The kit includes two separated compartments, one having a plurality of glass vials for receiving blood therein and one having a quantity of clay like material for sealing the ends of the vials after blood samples have been taken.

U.S. Pat. No. 5,261,531 issued on Nov. 16, 1993 to Nieves discloses a compact feminine hygiene package for cleaning the body after discharge of bodily fluids. The package includes compartments for storing a wet wipe, a dry wipe, and a sanitary napkin. The package may be disposed after a single use along with the used contents.

U.S. Pat. No. 5,439,104 issued on Aug. 8, 1995 to Wolska-Klis discloses an eyeglass cleaning station which includes a compartmented housing containing a dispensing bottle of liquid lens cleaning material and a dispensing box of disposable lens cleaning tissue.

U.K. Pat. No. 899,958 published on Jun. 1962 discloses a foldable note case containing a plurality of pockets for notes. A housing is provided in the region of the crease so that a battery operated electric torch may be stored. The torch is used to direct light onto the pockets.

U.K. Pat. No. 2,142,895 published on Jan. 1985 discloses a packaged glove wipe for removing powder from surgical gloves. The wipe is wetted with an alcoholic medium and contained in an airtight sachet.

None of the above inventions and patents, taken either singly or in combination, is seen to describe the instant invention as claimed.

SUMMARY OF THE INVENTION

In accordance with the objects of the invention, a medical clean up kit is provided for immediate in situ removal of spilled blood and other bodily fluids. The medical clean up kit is provided in a container having at least two distinct compartments. The compartments may each take the form of a bore which originates from the upper surface of the container and extends well into its lower portion. Each of the compartments are of sufficient volume to receive a supply of material for performing the clean up task.

In one of the compartments, a supply of moistened towelettes is provided. The second compartment contains a supply of dry towelettes. The supply of moistened towelettes contains appropriate types and quantities of agents necessary for terminating pathogenic activity. Once the spillage has been appropriately cleansed with the moist towelette, it may be further cleansed and dried with a dry towelette.

The container also includes a handle rigidly attached thereto. The handle provides a convenient means of grasping the container for immediate use and transportation. Depending on its particular shape or style, the handle may also be used for mounting the container to a temporary location.

A number of lids are provided for sealing the compartments.

The lids are removable and in the closed position, they provide a seal sufficient for containing any excess anti-pathogenic agent which may precipitate from the wet towelettes. Once the lid is opened, the towelettes may be easily dispensed from either compartments of the container.

Accordingly, it is a principal object of the invention to provide a medical clean up kit.

It is another object of the invention to provide a medical clean up kit which may be conveniently located in various hospital and medical environments.

It is a further object of the invention to provide a medical clean up kit which incorporates distinct compartments for storage of the items necessary to perform the clean up.

Still another object of the invention is to provide medical clean up kit including a supply of wet pathogenic destroying towelettes and a supply of dry towelettes.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
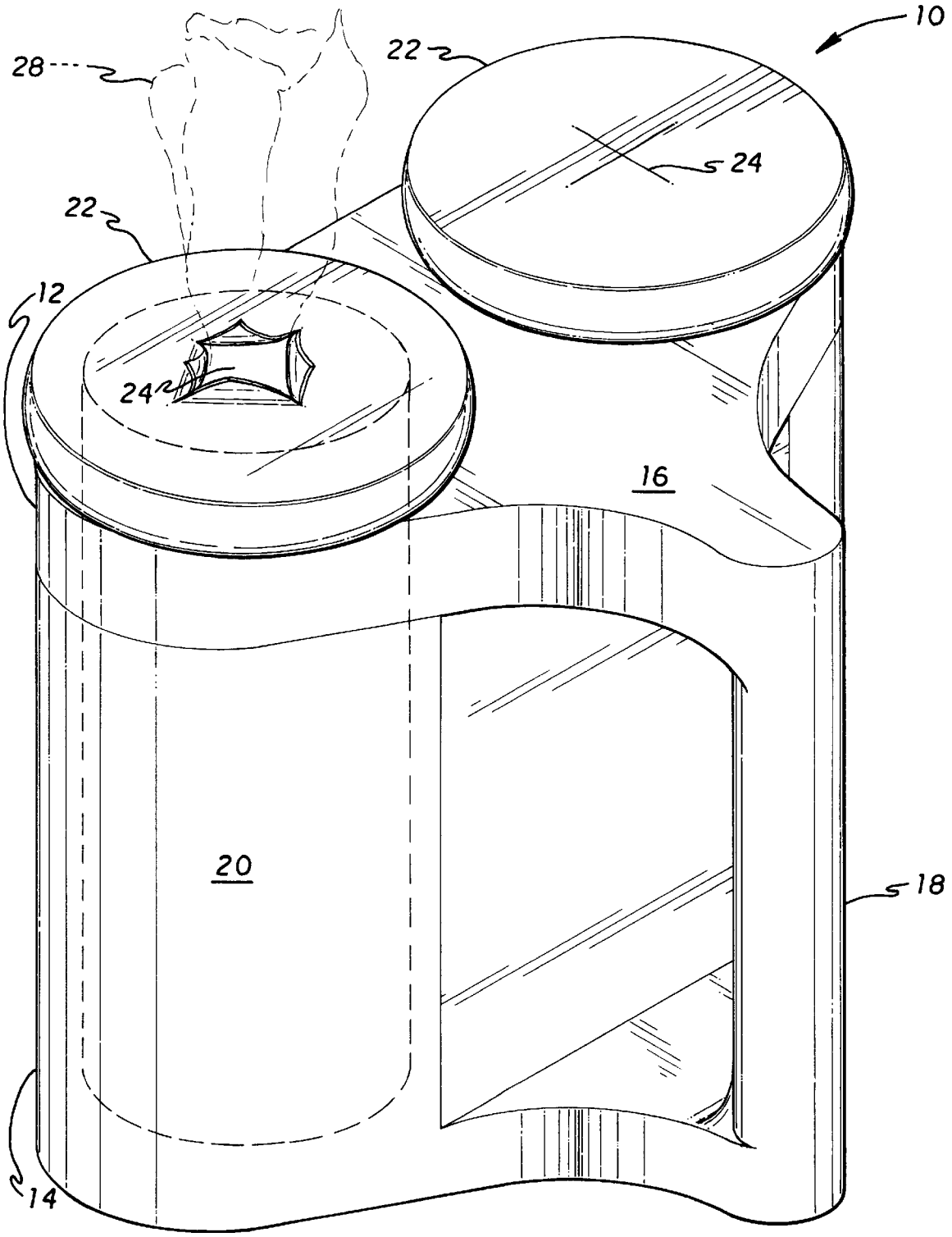
FIG. 1 is a perspective view of a medical clean up kit.
Figure 2:
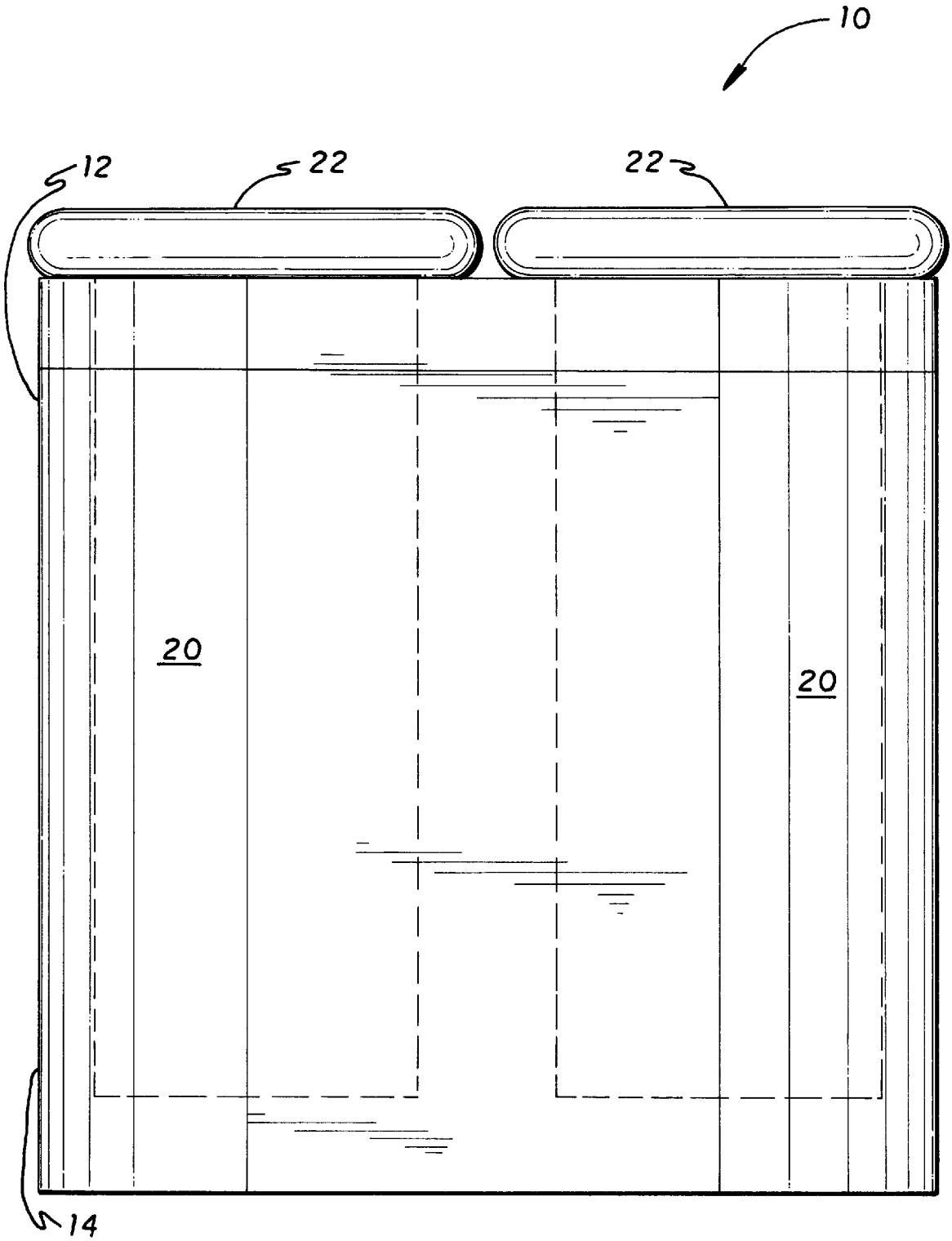
FIG. 2 is a front elevational view of the medical clean up kit.
Figure 3:
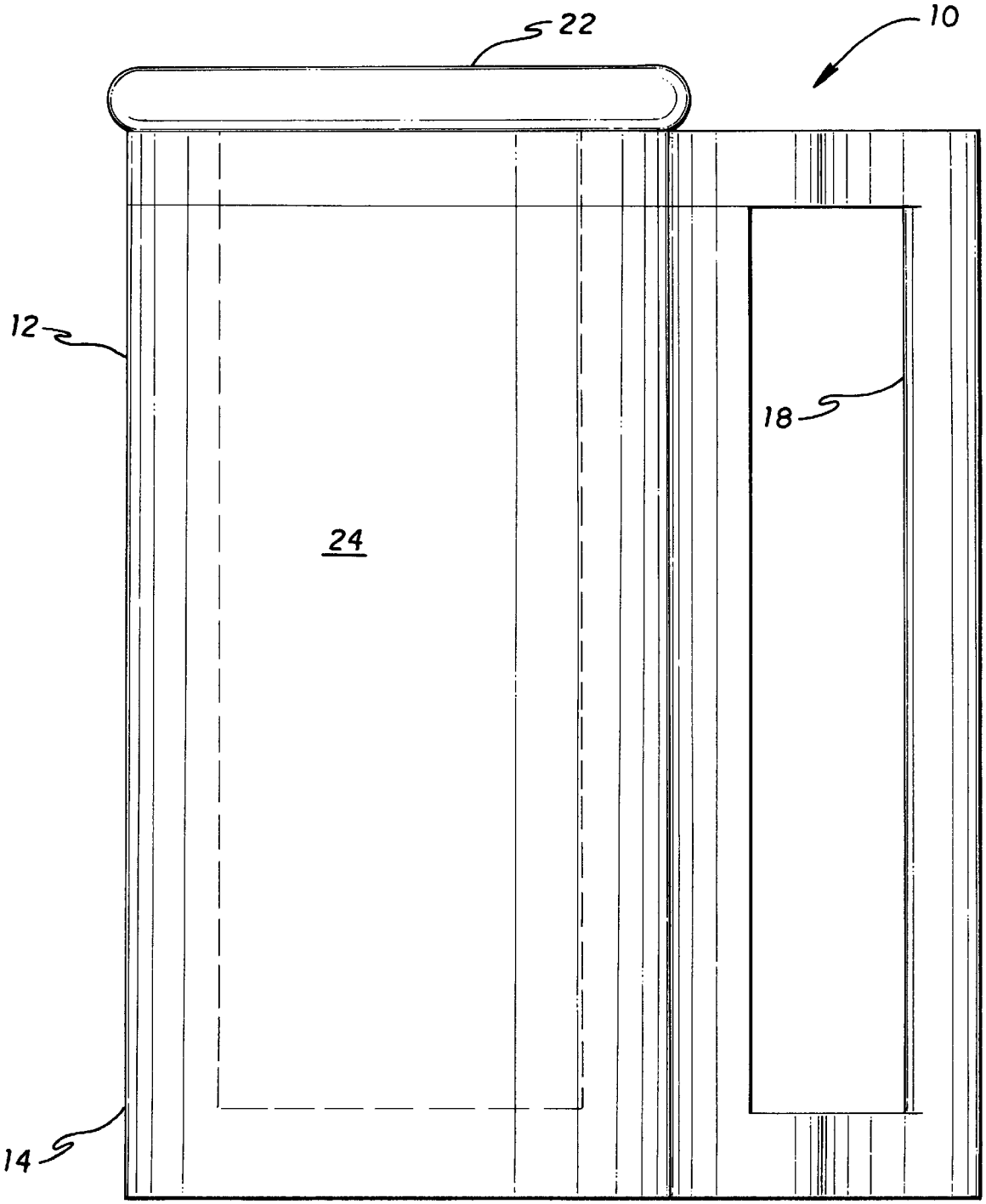
FIG. 3 is a side elevational of the medical clean up kit.

With reference to the drawings and initially to FIGS. 1–3, there is shown a medical clean up kit of the present invention which is in the form of a container of unitary construction indicated generally by the numeral 10. The container 10 includes an upper portion 12, an enclosed lower base portion 14 and a top surface 16. The container 10 can be made of a variety of rigid materials in order to provide strength and durability. Plastic, however, is preferred due to ease of manufacturing and its light weight. Plastic also affords the container 10 the ability to be repeatedly dropped without resulting in significant damage to another individual, another item, or the container 10 itself.

The top surface 16 serves as a point of origin for a number of compartments 20 which are in the form of cylindrical bores. Each compartment 20 extends through the upper portion 12 of the container 10 and into the lower portion 14. Each compartment 20 is appropriately configured and of sufficient volume such that a predetermined quantity of clean up material may be disposed therein. Each compartment 20 is also hermetically distinct from the other. While the compartments 20 have been illustrated as being cylindrical, it should be understood that there is no need for such physical limitation in configuration. Any type of cavity having sufficient volume for containing the clean up material may be used.

A handle 18 and a plurality of lids 22 are also included with the container 10. The handle 18 is integrally formed with the container 10 and is generally C-shaped. The handle 18 is attached at one end to the upper portion 12 of the container 10 and attached at the other end to the lower portion 14 of the container 10. The handle 18 provides a convenient means of grasping the container 10 and transporting it to the site where clean up is required. The lids 22 are provided equal in number to the compartments 20 contained in the container 10. Each lid 22 is of the same general cross-sectional area as its corresponding compartment 20. The lids 22 contain an otherwise conventional X or cross aperture 24 through which the contents of the compartments 20 may be dispensed.

Each of the lids 22 may be of the snap-fit variety, and retained in place simply by friction. Alternatively, the lids could be threaded into place, appropriate mating threading being provided at the top of each compartment wall and on an exterior, depending portion of each lid (not shown).

A supply of moistened towelettes 28 is dispensively stored in one of the compartments 20. The moistened towelettes 28 are preferably saturated with a predetermined quantity of anti-pathogenic agents in order to effectively perform the clean up task. Depending on specific applications, the anti-pathogenic agent may be an anti-viral, anti-bacterial, or anti-microbial solution. Alternatively, various combinations of hospital approved solutions effective for different types of pathogens may be used. A supply of dry towelettes (not shown) is dispensively stored in the other compartment 20. The dry towelettes are provided to complete the clean up task by removing any excess mixture of spillage and anti-pathogenic agent, thereby providing a clean and dry surface.

As a further alternative, one or both of the respective supplies of moistened and dry towelettes could be prepackaged, e.g., in a plastic wrapper or bag, and the entire supply, towelettes and packaging, may be dropped into the compartment(s).

Figure 4:
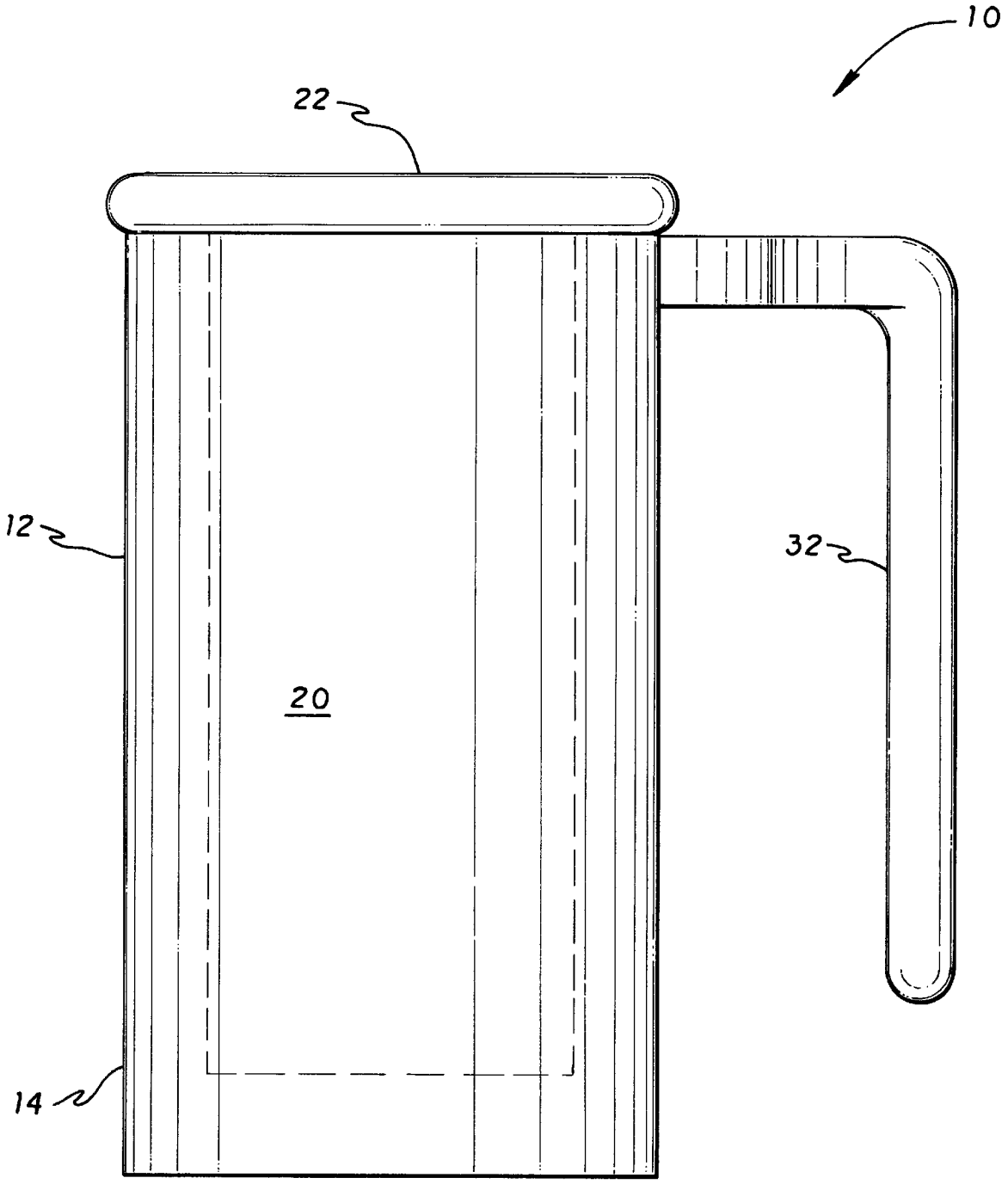
FIG. 4 is a side elevational view of an alternative embodiment of the medical clean up kit.

Turning now to FIG. 4, an alternative embodiment of the container 10 is shown. The container 10 includes an upper and lower portion 12, 14 as previously described. A compartment 20 in the form of a cylindrical bore is provided for dispensively housing AN LAW a predetermined quantity of clean up material. A lid 22 is used to seal the contents of the compartment 20. As illustrated in FIG. 4, the handle 32 of the container 10 is in the general shape of an inverted L. Such a handle 32 not only provides a convenient means for grasping the container 10, but also serves a means for hooking the container 10 along any horizontally disposed member.

Figure 5:
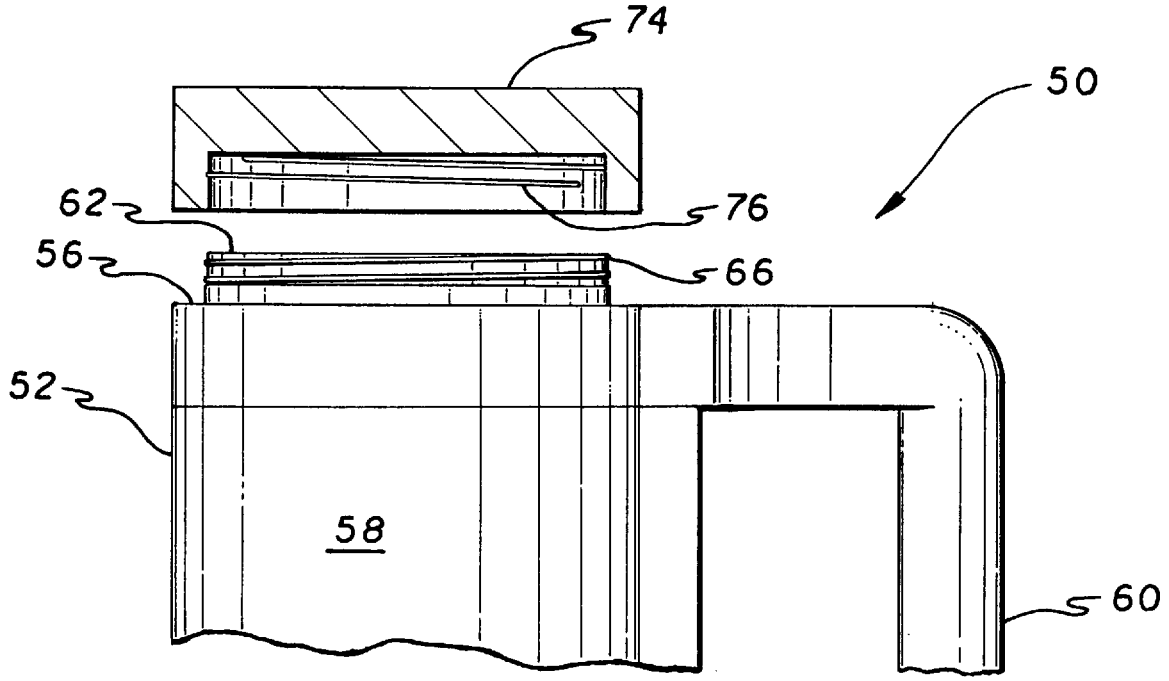
FIG. 5 is a side elevational view of a third embodiment of the medical clean up kit.
Figure 6:
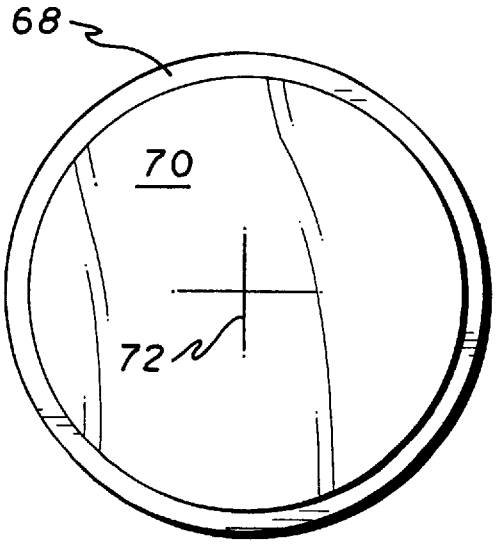
FIG. 6 is a top plan view of the lid used In the third embodiment.

FIGS. 5 and 6 illustrate yet another embodiment of the container 50 for the medical cleanup kit. The container 50 includes an upper portion 52, and a top surface 56. A plurality of compartments 58 (only one shown) originate from the top surface 56 and extend into the lower portion 54. A C-shaped handle 60 is attached at one end to the upper portion 52 of the container 50 and attached at the other end to the lower portion of the container (not shown), in a manner similar to that illustrated in FIG. 3.

A plurality of lids 62 corresponding to the number of compartments 58 is provided. Each lid 62 is attached to the upper surface 56 of the container 50 at such a location sufficient to seal its corresponding compartment 58. The lid 62 is provided with the same general cross-sectional area as its corresponding compartment 58 in order to effectuate the seal. The lid 62 includes a peripherally disposed thread 66. As seen more particularly in FIG. 6, the lid 62 includes a rigid outer member 68 of generally toroidal design. A flexible membrane 70 is disposed within the outer member 68 and peripherally secured thereto. An otherwise conventional X or cross aperture 72 is formed through the membrane 70 for facilitating the dispensing of the contents of the compartment 58.

A cover 74 is provided for detachably engaging the lid 62. The cover 74 also includes a thread 76 peripherally disposed therein for engaging the thread 66 included in the lid 62. The seal formed from the engagement of the cover 74 and the lid 62 is sufficient to contain any amount of anti-pathogenic agent which might precipitate from materials contained in the compartments 58.

It is to be understood that the present invention is not limited to tall embodiments described above, but encompasses any and all embodiments within the scope of the following claims.

We claim:

1. A medical cleanup kit for dispensing wet and dry towelettes, comprising:

a rigid container of unitary construction having a top surface and an enclosed base, said top surface including first and second openings;

a first compartment and an adjacent second compartment, each comprising a cylindrical bore, said first and second compartments respectively communicating with the first and second openings, each said compartment extending from said top surface to said base;

a supply of moistened towelettes housed in said first compartment and a supply of dry towelettes housed in said second compartment;

a first and a second lid respectively engaging the first and second openings to provide closure for each said compartment, each said lid includes a flexible membrane having a centrally disposed aperture therein for separately dispensing the moistened and dry towelettes; and a vertically oriented handle integrally formed with said container and depending from said top surface.

2. The medical cleanup kit as recited in claim 1, wherein said supply of moistened towelettes contain an anti-pathogenic agent.

3. The medical cleanup kit as recited in claim 1, wherein each said lid includes a rigid peripheral member having said flexible membrane secured thereto and an external thread disposed thereon.

4. The medical cleanup kit as recited in claim 3, further including a first and second cover, each said cover having an internal thread disposed therein for engaging said external thread of each said lid to seal each said compartment.

5. The medical cleanup kit as recited in claim 1, wherein said handle forms a generally C-shaped configuration with said container.

6. The medical cleanup kit as recited in claim 1, wherein said handle forms a generally inverted L-shaped configuration with said container.

* * * * *